US008032292B2

(12) United States Patent
Kiessling et al.

(10) Patent No.: US 8,032,292 B2
(45) Date of Patent: Oct. 4, 2011

(54) ELECTRICAL IGNITION METHOD FOR INTERNAL COMBUSTION ENGINES

(75) Inventors: Leo Kiessling, Cadolzburg (DE); Stanislaw Cichon, Fürth (DE)

(73) Assignee: Prufrex-Elektro-Apparatebau, Inh. Helga Muller, Geb. Dutschke, Cadolzburg (DE)

( * ) Notice: Subject to any disclaimer, the term of this patent is extended or adjusted under 35 U.S.C. 154(b) by 662 days.

(21) Appl. No.: 12/183,092

(22) Filed: Jul. 31, 2008

(65) Prior Publication Data

US 2009/0071441 A1 Mar. 19, 2009

(30) Foreign Application Priority Data

Aug. 1, 2007 (EP) ..... 07113616

(51) Int. Cl.
*F02P 5/15* (2006.01)

(52) U.S. Cl. ..... 701/110; 701/112; 123/406.56; 123/406.65; 123/600; 123/605; 123/618

(58) Field of Classification Search ..... 123/406.56, 123/406.57, 406.58, 406.59, 406.65, 600, 123/601, 605, 618; 701/110–113
See application file for complete search history.

(56) References Cited

U.S. PATENT DOCUMENTS 6,691,689 B2 * 2/2004 Kiessling ..... 123/603
6,701,896 B2 * 3/2004 Kiessling ..... 123/406.57
6,761,148 B2 * 7/2004 Kiessling ..... 123/406.57
7,156,075 B2 * 1/2007 Kiessling ..... 123/406.56
7,546,836 B2 * 6/2009 Andersson et al. ..... 123/605
2002/0117148 A1 8/2002 Kiessling
2009/0084368 A1 * 4/2009 Kiessling et al. ..... 123/601

FOREIGN PATENT DOCUMENTS

DE 2419776 A1 5/1971
DE 1954874 A1 2/1976

* cited by examiner

*Primary Examiner* — Hai Huynh
(74) *Attorney, Agent, or Firm* — Frank H. Foster; Kremblas & Foster

(57) ABSTRACT

An ignition procedure for internal combustion engines using multiple coils of a generator coupled to and turning synchronously with the engine. A magnetic field flows through the coils and generates a sequence of alternating current half waves induced in the coils. The half waves are used for: (1) charging an energy storage element that is discharged by an ignition switch via the primary coil winding for triggering an ignition spark; (2) processing via a control device for activating the ignition switch at an ignition time in dependence on the processed alternating current half waves and/or on the state of the internal combustion engine; and (3) the power supply for the control device (U8), and an operating mode for switching combustion off for the engine, whereby by means of the control device, the ignition switch is guided over less than the time span that is needed for a complete revolution of the magnetic generator.

15 Claims, 5 Drawing Sheets

Block Diagram According to the Invention

*) around 30° before upper dead end
**) around upper dead end
***) around lower dead center

ELECTRICAL IGNITION METHOD FOR INTERNAL COMBUSTION ENGINES

BACKGROUND OF THE INVENTION

1. Technical Area of the Invention

The invention relates to an electrical ignition procedure for internal combustion engines, whereby an arrangement of multiple electric coils and a magnetic generator is used, which is coupled to the internal combustion engine by its crankshaft for example, and which turns synchronously with it. With this, the magnetic field of the magnetic ignition generator flows through the coils at times, and a sequence of magnetic flux alterations is generated for each revolution. By this means, corresponding alternating current half waves are induced in the coils.

In the invention-specific ignition system, the alternating current half waves are used for the following:

- an energy storage element, for example an ignition capacitor, is charged with alternating current half waves and discharged via the primary coil winding of an ignition transmitter for triggering an ignition spark for the cylinder or other combustion space of the internal combustion engine.
- the alternating current half waves are scanned, detected, processed and/or evaluated or filtered by a microelectronic and/or programmable control device. An output result of this processing consists in determining an ignition time in dependence on the detected and evaluated alternating current half waves and/or on some other state of the internal combustion machine, such as its rotational setting or speed. In correspondence to the ignition time determined by the control device, the ignition switch is activated for generating an ignition spark.
- Additionally, alternating current half waves at least partially of the control device are forwarded to its voltage or current supply.

2. State of the Art

Figure 2:
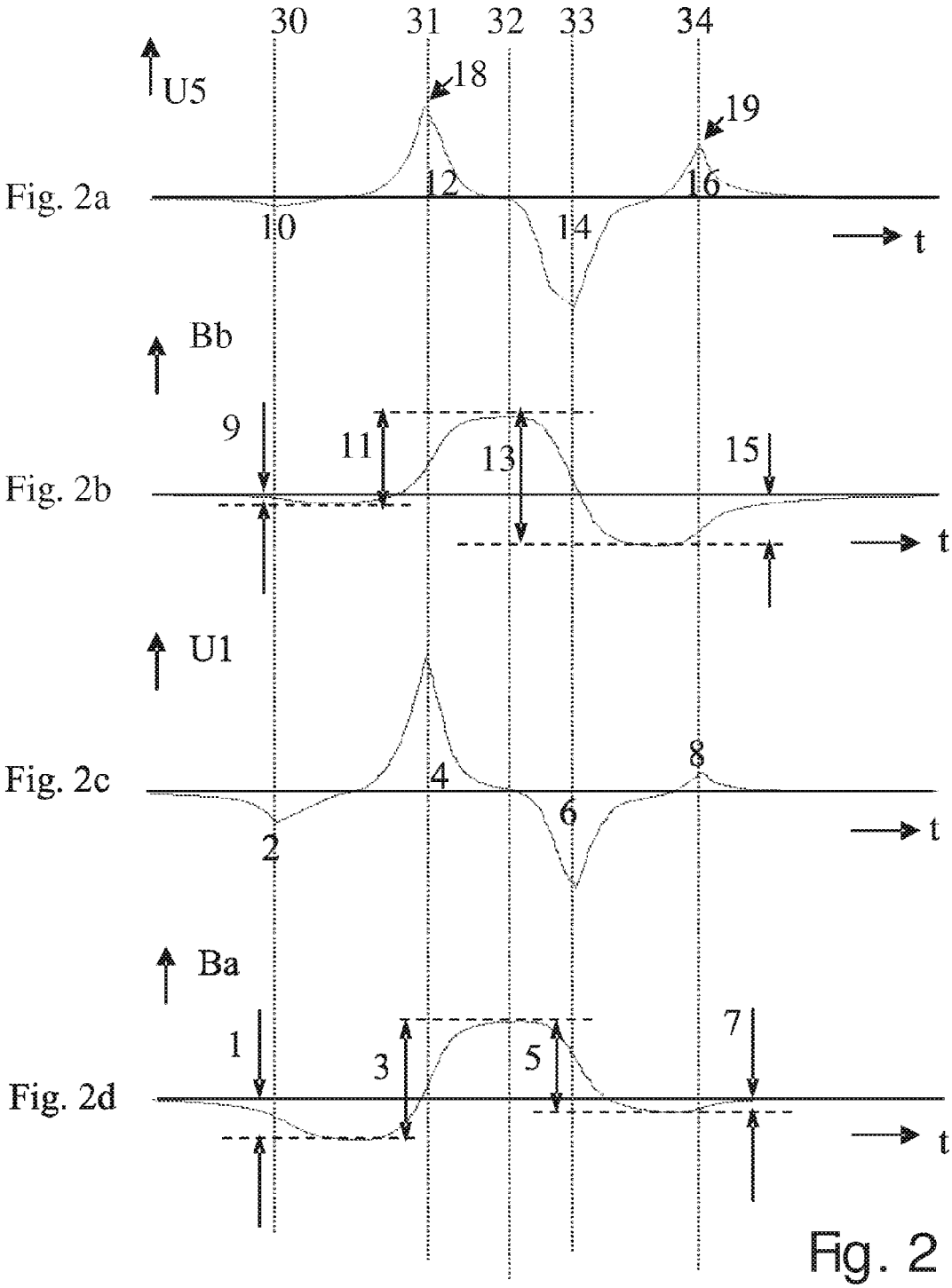

The German patent disclosure texts DE 19 54 874, with an English equivalent in U.S. Pat. No. 3,703,889, and DE 24 19 776, with an English equivalent in U.S. Pat. No. 3,993,031, and U.S. 2002/0 117 148 A1, describe ignition systems that each have speed limitations but without using digital and/or programmable control electronics. Alternating current half waves generated in the coils are used directly for controlling the ignition switch or to trigger the speed limitation. According to DE 24 19 776, when a permissible maximum speed is exceeded, the switching thyristor is guided to discharge the ignition capacitor of a negative half wave, which directly precedes a positive charging half wave for the ignition capacitor. By this means, the charging half wave can flow out over the break of the ignition thyristor, whereby a charging of the ignition capacitor is prevented and the ignition now is stopped. After attenuation of the charging half wave, the switching thyristor again goes back into a locked state. If, through stoppage of the ignition, the speed (again) drops below the maximum value, then the switching thyristor no longer is controlled for a sufficient duration by the (preceding) negative voltage impulse of a control winding. It is then already in a locked state with the start of the (subsequent) positive charging half wave. The ignition capacitor is now again charged, and by the ignition time, an ignition is introduced with the following voltage impulse of a control voltage. In any case, guidance of the ignition thyristor in the speed limitation also takes place at times (DE 24 19 776, FIG. 2 positive Us signal) when it does not have to be guided to short-circuit the positive charging half waves. From this a purposeless consumption of current arises. Additionally, the layout according to this state of the art is not at all suited for a current-saving concept with a digital control device. The guiding signal Us for the ignition discharge switch of necessity derives from the physical layout. US 2002/0 117 148 A1 teaches that with an active speed limitation via a trigger capacitor, a time window expands for guiding the ignition switch to prevent charging of the ignition capacitor by charging half waves to the extent that with excess speeds, the ignition switch is guided for an entire revolution, with corresponding current consumption.

From U.S. 2003/0 089 336 A1, an ignition system is known with a programmable microcontroller as the control device, which scans induced alternating current half waves in the magnetic generator, processes them internally, and from that can make assessments of the state of the internal combustion engine, especially its rotation setting, speed and rotary acceleration. According to ignition strategies that can be programmed in, an ignition switch can be intelligently guided. To supply current to the microcontroller, a separate supply coil is provided in the magnetic generator. The coil output is connected with a power supply circuit for the microcontroller. This has a special output to guide the ignition switch for the purpose of discharging the ignition capacitor. The goal of the published technical teaching is a lengthening of the ignition spark combustion duration with the named pusher effect while simultaneously optimizing the energy content of the ignition spark. Particular modes of operation such as switching off, limiting speed, or stroke disruption are not addressed.

EP 1 643 120 A2 shows a process-controlled ignition system in which pins of the processor chip are directly connected with the input winding of the magnetic generator. The external current to the processor chip is not limited. It is otherwise according to EP 1 496 249 A1, according to which a current supply unit for an ignition control microcomputer does have a current limitation resistance in the area of 2 kΩ). In its current supply path, for voltage stabilization, a direct controller is inserted with multiple components for supplying the microcontroller with current. In EP 1 496 249 A1, FIG. 15 shows that the ignition switch is guided with the signal s4 over a full revolution of the rotor, so that after recognition of the "shutdown" state (h1 in FIG. 15, part c), even after the shutdown switch 10 has been released (see FIG. 12), charging of the ignition capacitor is prevented by short-circuiting the positive charging half waves, for which see FIG. 15, signal e1.

US 2006/0 191 518 A1 discloses an ignition system guided by a processor or microcontroller with a stop button function to initiate a shutdown process of the internal combustion engine. After this button is released, it is necessary to continue preventing generation of ignition sparks until the engine shuts down. For this, the charging current for the ignition capacitor from an alternating current half wave is short-circuited by the ignition switch, to prevent charging of the ignition capacitor.

The "speed limitation," "stroke disruption" and "shutdown" operating modes are known. With each of these there is a reduction in speed, for which a spark shutoff is used fully or in part.

As is known per se, the "speed limitation" mode of an internal combustion engine (combustion motor) is initiated as soon as a certain motor speed is exceeded. For this the state of the art is to initiate a spark switchoff above the speed limitation, and thus on the spark plug, formation of an ignition spark is prevented. For this, the ignition switch is constantly guided above the speed limitation, to prevent a charging of the ignition capacitor, whereby the current from the charging coil is short-circuited to ground. The ignition switch is precluded from not being guided, since typically the combustion motor, in an instance where the load is slightly lessened, is accelerated over the limit speed so that it remains above this threshold for multiple revolutions, and thus the ignition capacitor would be charged up to a multiple of its permissible voltage. By means of voltage limitation components such as a varistor, this in fact would be prevented, but the component expense, and thus manufacturing cost, is increased.

in U.S. 2002/0 11 71 48 A1, as well as in the above EP 1 469 249, constant guidance of the ignition switch to switch off ignition sparks is depicted, for which see FIG. 11 in EP 1 496 249, with the signal s4 there depicting the guidance of the ignition switch. It is evident that when the speed is exceeded during a complete motor revolution, the ignition switch is guided, independent of what amplitude and polarity the induced voltage in the charging coil 6 (FIG. 2 in EP 1 496 249) has. The ignition switch itself is also guided if the ignition capacitor would not be charged by the charging coil, the disadvantage being that current is consumed unnecessarily.

From the state of the art indicated above, it is clear that a part of the energy derived from the flux changes in the magnetic generator is used to supply the control electronics. This need to be supplied is composed decisively of the current consumption for a microelectronic control device and the guidance of the ignition switch. With modern microprocessors, the current consumption of the microelectronic control device can be much reduced, values under 1 milliampere can easily be met. By this means, the share of the guidance current for the ignition switch attains ever greater significance in the overall current supply. For the most part, the guidance current for the ignition switch is at several milliamperes, which is also caused by the fact that according to circuit technology, a resistance is always switched parallel to the control input of the ignition switch to ground. By this means, insensitivity to disturbing effects, and especially protection against being switched on erroneously is achieved.

It can be said by way of summary from the state of the art that with activated ignition switches, the current consumption determines the layout of the control device's power supply. A preset amount of energy is drawn from the charging coil into the control device's power supply, therefore the coupling between the charging coil and the power supply can be designed to be preset in how high the ohmage is.

One task of the invention is to ensure the ignition switch will be guided most of all during shutoff operations, even when, owing to the ignition module being wrongly installed in service, the air gap between the rotating magnet wheel and the rewound yoke core deviated from the 0.3 mm at most that is nominal to 2 mm, for example.

An additional task of the invention consists in being able to use structural components for the ignition system that have increased mechanical tolerances and thus lower costs. For example, the installation play in the attachment boreholes of the yoke care should permit setting of a relatively large air gap when parts are unfavorably paired. When the air gap is large, the voltage falls, which is induced in the charging coil surrounding the yoke core, and therefore a further task of the invention is to be able, by means of circuit-technical dimensioning within the ignition system, to divert enough current from a charging coil surrounding the yoke core, despite increased mechanical tolerances, to supply the control device with power.

To fulfill certain relationships and boundary conditions of various motor types, the "stroke disruption" operating mode is known, in which, similar to with the speed limitation, an ignition spark shutoff or suspension is used as a combustion shutoff, multiple times according to a certain pattern. In particular, the "stroke disruption" operating mode is used at relatively low speeds, such as idling. With this, a problem arises in that for discharging of the ignition capacitor, the ignition switch must be given more lengthy guidance, since with the relatively low speed, the period duration of a revolution is longer. Thus the task of the invention is to be able to ensure energy removal for the ignition switch control device at low speeds, down to idling.

OUTLINE OF THE INVENTION

The invention, with the procedural steps named at the outset in connection with an operating mode for combustion shutoff, such as speed limitation, stroke disruption, switchoff, with an internal combustion engine to guide the ignition switch for less than, or for a fraction of the time span, that is needed for a complete revolution of the magnetic generator. With the invention, the advantage is attained that energy consumption for guiding the ignition switch is lessened.

According to a special embodiment (claim 2) of this general basic idea of the invention, the ignition switch is only guided in the angular ranges in which the ignition capacitor would be charged by the magnetic generator's charging coil or possibly by other coils. By this means, the energy consumption for guidance of the ignition switch can be reduced by about a factor of 2-4 as compared to the state of the art.

According to another embodiment of the invention (claim 5) the ignition switch is guided by means of the control device for each revolution of 360° by an electrical impulse or another sequence of electrical, temporally spaced impulses (impulse bundle burst). In this the pauses between the impulses are dimensioned so as to prevent a sparkover and thus an acceleration of the internal combustion engine's revolutions. In a further embodiment of this concept (claim 5), the pulse or the impulse sequence are generated exclusively within the appearance of unipolar charging half waves or within such rotation angle ranges, in which alternating current half waves are available for charging the energy storage element. The pauses between the impulses or the keying ratio is selected to be so wide or so low that the voltage value of the ignition capacitor is not increased enough that with the next switching on of the ignition capacitor, a sparkover could occur on the spark plug through its discharge.

According to a further embodiment of the invention (also see claim 7) the particular time interval between the guidance impulses and thus the keying ratio is stored in a storage area of the programmable control device. Depending on the rotation setting and speed or other characteristic values of the ignition system, a processor of the control device can extract various time interval values for the generation of the pulses that follow each other.

Note that according to the state of the art a thyristor is preferably used as an ignition switch for the capacitor discharge ignitions. This remains conductive as long as a certain stop current is not fallen short of over the gap. As a precaution, an assumption is to be made of the most unfavorable condition, that namely the stop current is fallen short of, and thus the ignition switch must repeatedly be re-guided. Thus, for the guidance of the ignition switch, the highest possible power requirement is to be allowed for.

With use of the electrical pulse or some other sequence of electrical impulses for guiding the ignition switch, the energy consumption is still further lowered by about a factor of 1.5 to 4 versus the basic idea of the invention named above.

As a precaution we make clear that with the above embodiments of the invention, the ignition capacitor must first be discharged before a charging current is short-circuited by guiding the ignition switch, so as not to trigger any ignition sparks.

On the other hand, with an alternative embodiment of the invention, a suggestion is made to achieve a spark suspension by guiding the ignition switch within an angular range that is irrelevant as regards torque generation, where thus the motor is not further accelerated, the ignition switch is guided to prevent the ignition capacitor from being charged excessively, as per claim 10. This means that through an ignition spark triggered in this angular range through the discharge of the ignition capacitor, the machine does not gain any speed and that the ignition spark produces no hazard for the machine. For example, a flame rebound to the carburetor would endanger the machine.

Among other things, the invention is based on the concept of supplying power for the control device and subsequent assemblies with as little energy, and thus current, as possible. The main consumer is the guidance process of the ignition switch, especially the ignition thyristor. Thus, the temporal and/or angular range of the guidance process determine to an important extent the energy requirement of the supply of power or current.

Part of the overall invention concept is also an ignition module (see claim 15) that is distinguished in that a power supply input of the control device is coupled to a charging coil of the magnetic generator, between which an ohmic resistance of more than 3 kΩ is switched. The invention-specific measure of deliberately guiding the ignition switch at certain times, and not over the entire full angular range of a 360° revolution, serves the goal of designing this resistance to be as high in ohmage as possible. According to the invention, an effort is made to dimension the named coupling resistance to be as high as possible, to reduce the current uptake of the control device's power supply, so that all the more energy is available for the ignition energy storage device. It is by just this energy-saving guidance of the ignition switch according to the invention that it is possible, despite incorrect installation of the air gap between the iron yoke core and the rotating magnet wheel to two or three millimeters as mentioned above, for example, to nonetheless use a coupling resistance of more than 3 kΩ that is dimensioned so relatively high.

A further basic idea of the invention is based on dividing the energy available for the entire ignition system from a charging coil of the magnetic generator with a microelectronic and/or programmable control device to its power supply device and to the ignition capacitor or the energy storage element. Ultimately the energy content of the energy storage element determines the spark energy. The less energy that flows into the power supply of the microcontroller and its peripheral components, the more energy is available to the energy storage element or ignition capacitor. One measure for the energy content of the energy storage element or ignition capacitor is its voltage amount. If the current or power supply of the control device emits little current, the coupling or compensating resistance between the charging coil and the power supply input is raised, so that correspondingly more energy gets to the energy storage element or the ignition capacitor. In the "spark arrest" operating mode, according to the state of the art, the ignition switch is guided multiple times over a full revolution or 360°. However, if, according to the invention, the ignition thyristor or some other ignition switch device is supplied only at certain angular ranges and not over the entire revolution with power and current, this saves energy that is available to the energy storage element or ignition capacitor and thus to the ignition spark.

Figure 1:
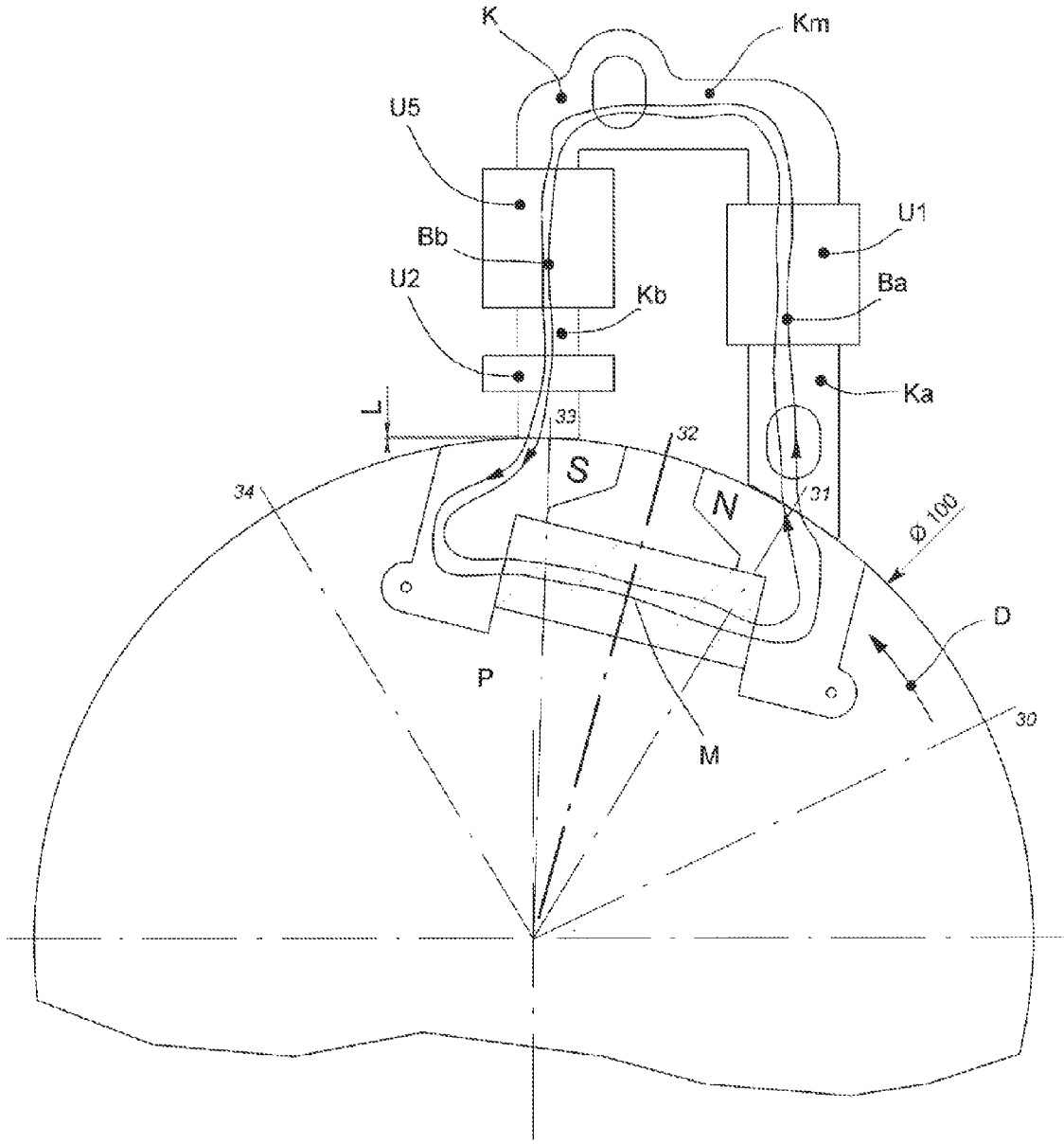
Figure 3:
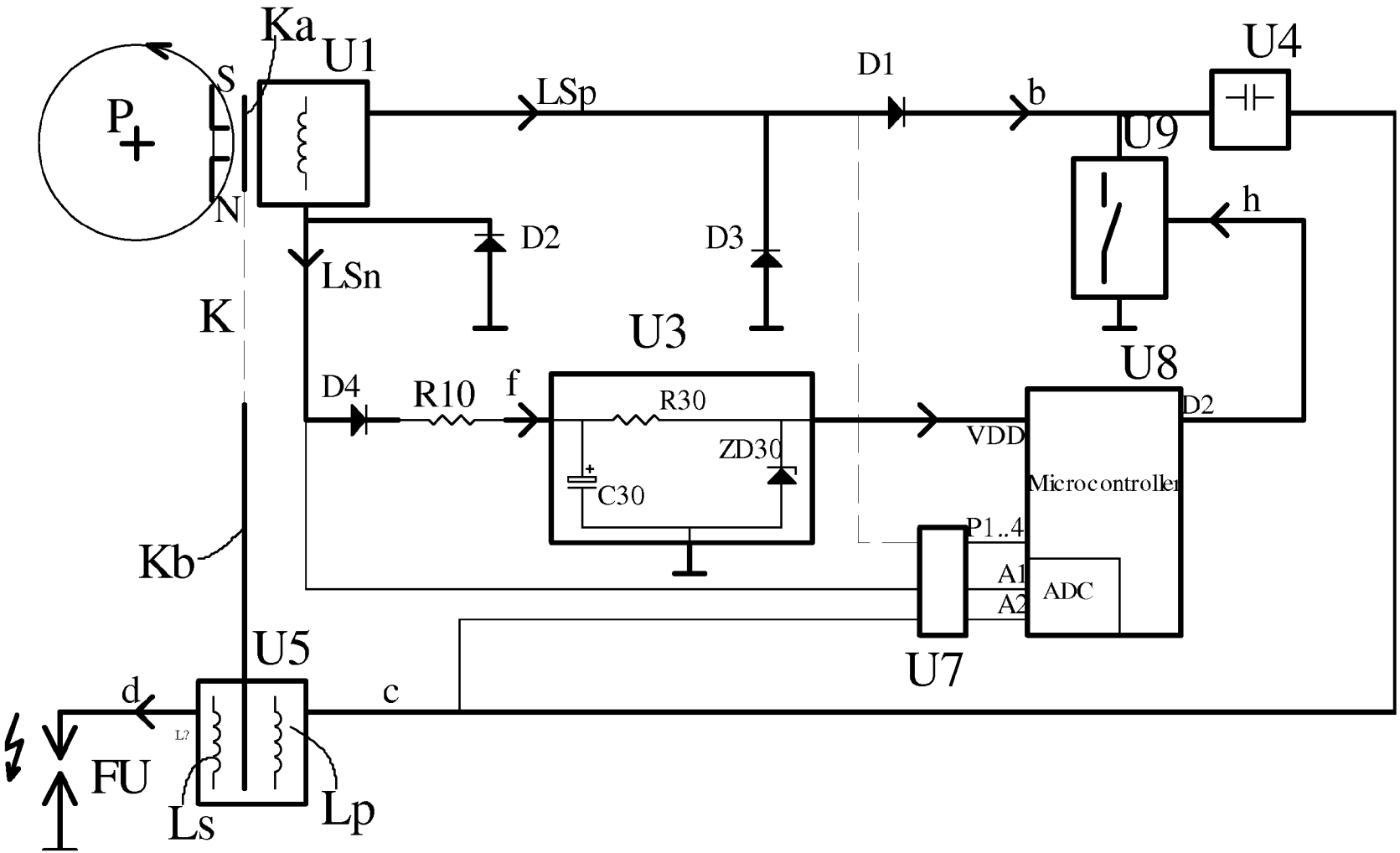
Figure 5:
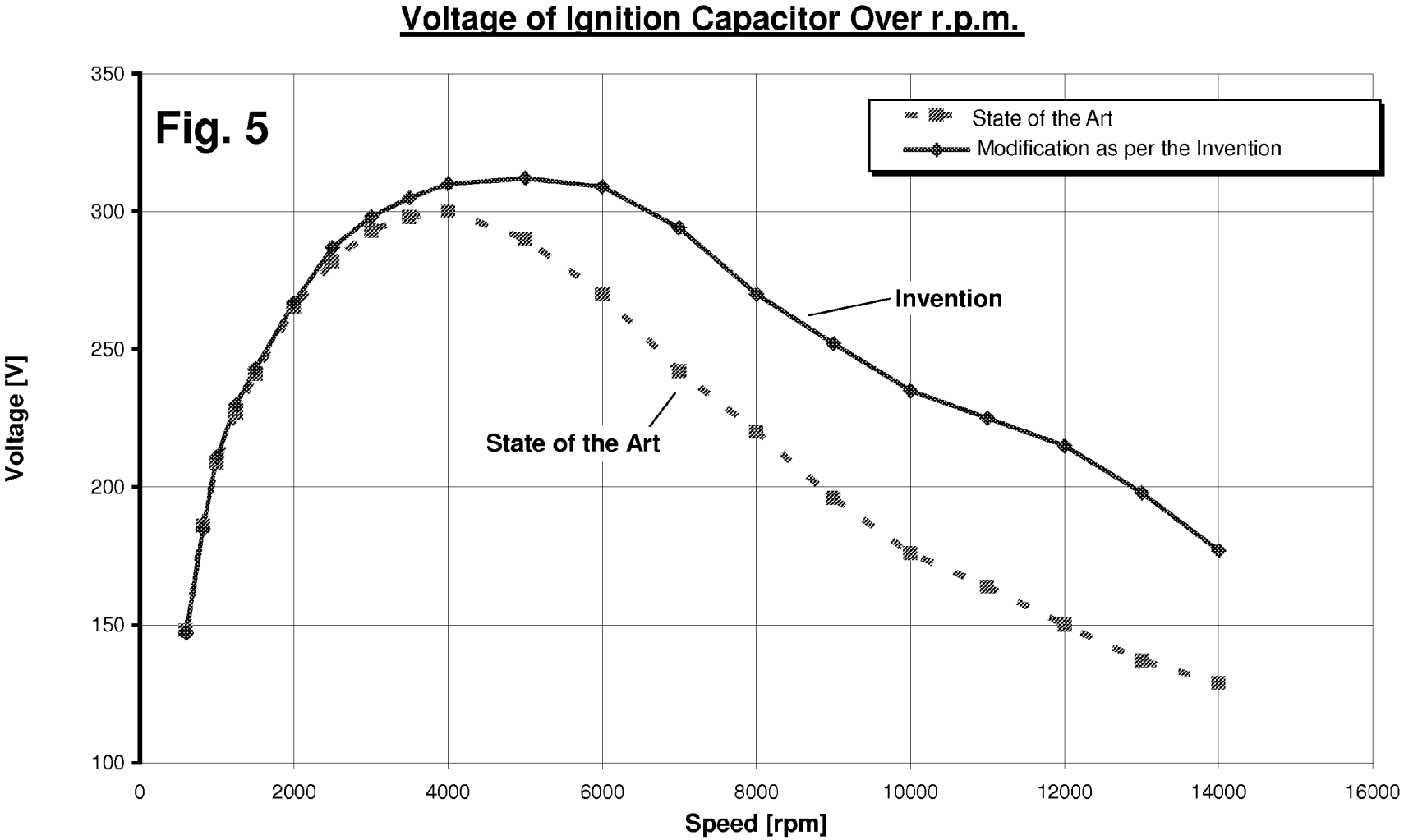

Further particulars, features, advantages and effects based on the invention are gleaned from the following description of a preferred embodiment example of the invention, as well as from the drawings and diagrams. Shown in them are:

FIG. 1 in an axial, partial plan view, the design and interaction of the magnetic generator with at least one part of the ignition module;

FIGS. 2*a*-2*d*, the progressions of the voltages prevailing in the coils and magnetic fluxes through iron core sections over the particular same turning angle of the motor;

a schematic block diagram of the invention-specific ignition module;

FIGS. 4*a*-4*f*, the method by which the invention-specific ignition module functions as per FIG. 3, using voltage and/or current-time diagrams;

FIG. 5, a diagram with the charging voltage of the ignition capacitor over the speed in comparison between the invention and the state of the art.

According to FIG. 1, a magnet wheel P is placed and coupled with a combustion engine that is not shown so that magnet wheel P rotates synchronously with a crank shaft of the combustion engine. In the peripheral area of magnet wheel P, a permanent magnet M is structurally integrated, about whose polar areas magnetically conducting pole shoes S, N are attached. The parts named are the moving components of a magnetic generator P, M, S, N, which is turned by the combustion engine counterclockwise in a turning direction D. The magnetic poles or pole shoes S (south pole), N (north pole) are, in their named sequence, moved on an iron, soft-magnetic yoke core K at first to its first leg Ka and then to its second leg Kb. The two legs Ka, Kb are connected to each other by a central piece Km of yoke core K, forming a U shape. With each turn in the direction D, the yoke core K or its legs Ka, Kb are subjected periodically via an air gap L to a magnetic flux Ba or Bb passing through. The first leg Ka to subjected to through flux in turning direction D is surrounded by a charging coil U1, wherein a voltage is induced by the magnetic flux changes arising with having been rotated past.

According to FIG. 3, with this charging voltage LSp, via a diode rectifier D1, an energy storage element U4 in the form of an ignition capacitor is charged. An ignition switch U9 that is connected with the input of energy storage element U4 and is able to be switched through to ground is guided at a certain angular setting (ignition time) by a trigger switch or control device U8, whereby the energy storage element U4 discharges via the primary coil Lp of an ignition transmitter U5. The latter according to FIG. 1 is placed with its primary and secondary coil Lp, Ls about the second yoke core leg Kb in turning direction D. According to FIG. 3, the output LSn of charging coil U1 is connected with a power supply unit U3, which makes ready the operating voltage VDD for the control device U8, for example a programmable microcontroller. Additionally, the control device U8 is so designed that it requires only a small amount of energy from charging coil U1. Also, a compensating resistance R10 for coupling the power supply U3 to the negative output LSn of charging coil U1 serves it. The energy consumption of the supply voltage component U3 for the control device U8 has a substantial influence on the charging and the energy content of ignition capacitor U4. This energy consumption is strongly determined by the type coupling of the supply voltage component U3 to charging coil U1. An extremely simple, cost-effective coupling is attained by inserting the coupling resistance R10 before the parallel switching from the electrolyte capacitor C30 and the resistance R30. The current consumption of control device U8 is at its greatest in the case of low speeds and long guidance times resulting therefrom of ignition switch U9. This case strongly contributes to determining the value of resistance R10.

Owing to the reduced consumption attained according to the invention for the guidance of ignition switch U9, the coupling resistance R10 can be enlarged to more than 2 kΩ, and in fact without use of a direct regulator, for which see above in the assessment of the state of the art. As part of the invention, a value of more than 3 kΩ is applied for the coupling resistance R10. Due to the mechanical design, the air gap L between the magnet wheel P and yoke core K is adjustable according to a standard to a maximum of one millimeter. With this, on the basis of the invention-specific ignition switch control device, the coupling resistance R10 can be increased to 10 kΩ. This leads to a considerable increase in charging current, and thus of the charging voltage of the ignition capacitor at high speeds, as is illustrated using the appended diagram according to FIG. 5.

According to FIG. 5, especially at high speeds, the charging voltage of the ignition capacitor increases, if in the example the coupling resistance R10 of 0.3 kΩ is raised to 10 kΩ. The following values were for the charging voltage (Uc) on the ignition capacitor U4 at various values of the coupling resistance R10, at a speed of 12000 revolutions per minute (with the factor of energy increase in the ignition capacitor), whereby the energy increases as the square to voltage (Uc):

R10=0.3 kΩ, Uc=148 volts; energy increase factor=1, according to the state of the art R10=3.2 kΩ, Uc=184 volts, energy increase factor=1.54

R10=10 kΩ, Uc=215 volts, energy increase factor=2.11

According to FIG. 3, the control device U8 is provided internally with an analog-to-digital converter ADC with at least the two analog signal scanning inputs A1, A2. Placed ahead of this is a signal level attenuation circuit U7, that is adjustable by means of port attachments P1 . . . P4 of control device U8 through them, and adaptable to the particular signal strengths of the coils. On the input side, the attenuation circuit U7 is connected with the negative output LSn of charging coil U1 and parallel with the voltage signal c of the primary coil Lp, in order to add these signals, each attenuated according to the states of the port attachments P1 . . . P4, to the signal scanning inputs A1, A2 of control device U8. From the sequence of voltage signals LSn of charging coil U1 and the voltage signals c of primary coil Lp, the control device determines the state of the combustion engine, including speed, rotational setting, and rotational direction, and thus it can guide the ignition switch U9 in timely fashion. With the aid of a stroke generator which is not shown, which is connected externally of the control device U7, a time indicator or time counter can be formed internally in the control device U8, which, in combination with the analog-to-digital converter ADC using the alternating current half waves detected via the attenuation circuit U7 from charging coil U1 and primary coil Lp, can measure the particular time duration for various angular sections. Depending on the evaluation of the time duration of detected angular sections, ignition switch U9 can be activated at the determined ignition time via the guiding output h of control device U8. The discharge side of ignition capacitor U4 is connected directly with primary coil Lp of ignition transmitter U5 that surrounds the second yoke core leg Kb. Thereby is coupled the secondary coil Ls that is designed for up-transformation and likewise surrounds the second yoke core leg Kb, whose output leads to the spark plug gap FU. By guiding the ignition switch U9 with the ignition capacitor U4 charged, the latter is discharged via the primary coil Lp of ignition transformer U5. In the secondary coil Ls that is coupled with primary coil Lp, which has roughly 100 times the winding number, a high-voltage impulse is generated, which evokes a spark discharge at the spark plug FU.

In what follows, the following is presented on the operational procedure of the invention-specific ignition system:

In FIG. 1, for the magnetic generator M, S, N, its radial lines of symmetry in various rotational settings 30, 31, 32, 33, 34 are drawn in. These correspond with the magnetic flux changes 1, 3, 5, 7 in FIG. 2*d*, as well as 9, 11, 13, 15 in FIG. 2*b*, and with the alternating current half waves 2, 4, 6, 8 in FIG. 2*c* and 10, 12, 14, 16 in FIG. 2*a*, whereby the depicted temporal courses for the individual leg magnetic fluxes Ba, Bb and the coil voltages U1 and U5 are added to each other in a temporally identical scale and time sections equal to one another, corresponding to their particular time-synchronous appearance. The voltages on the Y axes are depicted with differing scalings, each according to differing coil winding numbers. For better illustration of the physical connections, in FIGS. 2*a* to 2*d*, the appearance of the rotational settings of the magnetic generator is also marked using positionally stable, radial lines of symmetry 30-34.

Figure 4:
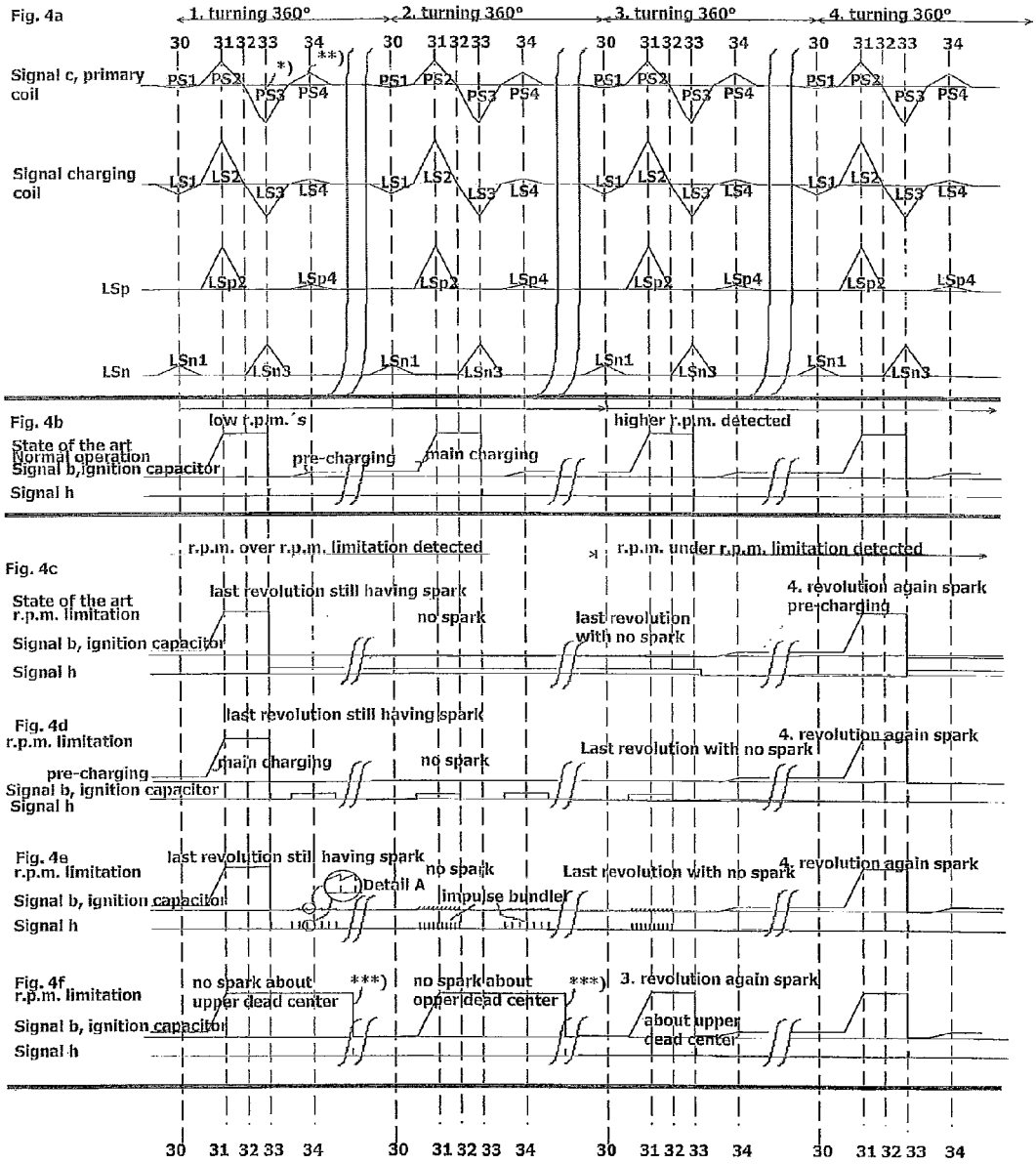

For orientation and to depict the varied rotational angle of magnetic wheel P, in FIG. 4 the positionally stable, radial lines of symmetry 30-34 are transferred over, as in FIGS. 2*a*-*d*, as continuous vertical lines for making the individual times at which the particular rotational settings of magnetic wheel P appear. Thus the signal progressions in the ignition module can be depicted in various scalings along the vertical axis over the particular equal turning angles of the combustion engine.

FIG. 4*a* shows a simplified schematic of the progressions of the signals induced in the coils, divided according to the particular positive and negative alternating current half waves, with PS1-PS4 as primary coil signals and LS1-LS4 as charging coil signals. In this it is perceptible that at radial symmetry line 33, corresponding to the 30° rotational setting of the combustion engine or magnetic wheel, before the upper dead center OT of the internal combustion engine, the negative alternating current half waves PS3 in the primary coil appear, and LS3 synchronous to that in charging coil U1. The particular last alternating current half waves PS4, LS4 appear with their apexes in the area of the upper dead center corresponding to symmetry line 34. As per the circuit arrangement in FIG. 3, according to FIG. 4*a*, lower half alternating current charging half waves LSp2 and LSp4 are withdrawn for the charging of ignition capacitor U4 via a diode rectifier D1, from which the voltage b of ignition capacitor U4 is built up. From the negative half waves LS1, LS3 of the charging coil, rectified, positive half waves LSn1, LSn3 are generated by means of diode rectifier D4 to feed power supply module U3. The half waves LS1, LS2, LS3, LS4 as per FIG. 4*a* correspond to the half waves 2, 4, 6, 8 as per FIG. 2*c*.

According to the depiction of a fictitious state of the art with normal operation and with no speed limitation in FIG. 4*b*, at about symmetry line 33 or the corresponding rotational setting of magnetic wheel P or of the combustion engine, the guiding signal h for the ignition switch appears, through which the ignition capacitor U4 is discharged. The capacitor voltage b drops. Based on the alternating current half wave LS4 and the second charging coil half wave LSp4 derived from it, about in the area of the upper dead center OT (angular setting 34) a pre-charging starts to appear, which, when the first positive charging coil half wave LSp2 comes into existence, passes into the buildup of the main charging for ignition capacitor U4.

With the fictitious state of the art that is illustrated in FIG. 4, the mechanism of the speed limitation is shown. When a speed threshold is passed, via the ignition switch guiding signal h, the ignition switch is activated within the first revolution (last revolution where sparking still takes place) and the ignition capacitor is discharged. The ignition switch guiding signal then remains over the second and third revolution in a "true" state (high-level), resulting per se in unnecessary consumption of current. If during the third revolution it is detected that the current speed has again dropped below the speed limitation threshold, immediately after rotational setting 33, within the third revolution, the ignition switch guiding signal h is withdrawn, so that when the second charging coil half wave LSp4 appears, a pre-charging can again be built up, that remains until the fourth revolution.

FIG. 4*d* illustrates an embodiment example of the invention-specific ignition switch guiding procedure. After recognition by the control device that a speed limitation threshold has been exceeded, and discharge of the ignition capacitor about 30° before the upper dead center (symmetry line or angular setting 33), a new discharge of the ignition capacitor is triggered. For this, around the symmetry lines 31 and 34 an ignition switch guidance impulse h is generated by the control device. Consequently, the charging coil half waves LSp2 and LSp4 having positive polarity cannot be converted into capacitor charging, but rather are short-circuited by the ignition switch. If the speed again drops below the speed limitation threshold, which is monitored by the control device, the specific ignition switch guidance is adjusted about twice per revolution respectively in the area of a positive charging half wave, so that at about the end of the third revolution (vertical symmetry line or angular setting 34 there), again a pre-charging can be built up in the ignition capacitor.

The embodiment example of the invention-specific procedure according to FIG. 4*e* differs from that according to FIG. 4*d* in that around the turning angle settings 31 and 34, a pulse (sequence of periodic impulses) is generated, whereby the duration of the pulse agrees approximately with the duration of the respective charging coil half wave LSp2 and LSp4. For thyristors that are customary in practice or used, within a pulse or bursts of impulses or impulse bundle, a guiding impulse with a duration of 5-10 microseconds is needed. Between the individual impulses of a pulse there can be a pause of about 100 microseconds. The detail A in FIG. 4*e* shows a signal section zoomed (enlarged) with the sawtooth pulsing ignition capacitor charging voltage b at the lowest level and the individual ignition switch guidance signals h. In other respects the procedure according to FIG. 4*e* runs similar to that as per FIG. 4*d*.

With the embodiment examples as per FIGS. 4*c*-4*f*, it is assumed that the first revolution depicted exceeds a threshold value for speed limitation. The recognition that the speed is too great is present in the signal-processing unit for the turning angle setting 30, for example. For this, for example, the time from the rotational setting 34 of a revolution not shown, that occurs before the first revolution, until just the rotation angle setting 30 of the 1st revolution can be measured for the speed determination. From the revolution before the first revolution, thus the revolution not depicted, a pre-charging has arisen in the energy storage element or ignition capacitor. Consequently, the main charging at the ignition capacitor cannot be prevented, since otherwise when the ignition switch U9 is guided by discharging the pre-charging via the primary coil Pp, an ignition spark could be triggered. Therefore, in the first revolution, ignition takes place and in the area of rotational setting 34 the positive charging half wave LSp4 is short-circuited, thus to prevent pre-charging of the ignition capacitor. Thus, now in the second revolution, charging up can be prevented without having to give attention to a pre-charging, and thus a possible spark discharge.

With the embodiment examples as per FIGS. 4*c*-4*f*, the speed of the first revolution exceeds that of the speed limitation threshold, so that the speed limitation mechanism commences and the speed drops. At the start of the third revolution, the control device U8 recognizes that the speed has fallen below the speed limitation threshold. Thus the ignition at the start of the third revolution again is cleared or initiated. As depicted, this can occur so that on the third revolution, first the pre-charging is permitted, so that then in the fourth revolution the triggered ignition spark can be fed with energy both from the pre-charging and from the main charging, as depicted in FIGS. 4*d* and 4*e*.

According to FIG. 4*f*, with the commencement of speed limitation starting from the first revolution up to and including the second revolution, the ignition switch is guided with the signal h first in the area of the lower dead center UT, thus long after the last marked rotation angle setting 34 about for the upper dead center to discharge of the ignition capacitor. The ignition capacitor voltage b is thus discharged suddenly only in the area of the lower dead center. Already in the third revolution is there again a release for ignition spark generation in the area about the upper dead center OT, since in fact the main charge is already contained in the energy storage device. Thus, first of all, reactions to speed conditions are quicker, and second, the ignition capacitor in this version can also be discharged if a charge is found on the ignition capacitor, and thus a spark discharge is to be expected. The two versions can be combined with each other, thus discharge ignition sparks to UT or preventing the ignition capacitor from charging. With a discharge of the ignition capacitor in the lower dead center UT, i.e., in a state where combustion is switched off, no combustion takes place as a rule. In some special operating conditions, partial combustion can result; but this does not lead to an increase in the speed of the internal combustion engine.

It is also within the scope of the invention that the embodiment forms described can also be used on capacitor magnetic ignition units in which the iron yoke core K consists of three legs, or in which the named coils are divided up in another way.

LIST OF REFERENCE SYMBOLS

P Magnetic wheel
M Permanent magnet
S, N Pole shoes
D rotational direction
K yoke core
Ka first leg
Kb second leg
Km middle piece
L air gap
Ba, Bb magnetic flux
U1 Charging coil
U3 power supply for control device
U4 Energy storage element or ignition capacitor
U9 ignition switch
U8 control device
U5 ignition transmitter or ignition transformer
ADC analog-to-digital converter
A1, A2 signal scanning inputs
VDD operating voltage (2.5 . . . 5.5 V)
U7 signal level attenuation circuit
P1 . . . P4 Port attachments (digital outputs of the control device for switching of U7)
LSp positive half waves
LSn negative half waves b voltage of the ignition capacitor
c Primary voltage signal, with the half waves PS1, PS2, PS3, PS4
d high voltage impulse
f voltage of the suppy voltage, on the electrolytic capacitor
h ignition switch guidance signal
Lp primary coil
Ls secondary coil
FU ignition spark gap
D1, D2, D3, D4 rectifier
R10 compensating resistance for power supply coupling-coupling resistance
C30 power supply capacitor
GND ground
ZD30 voltage stabilization diode
30-34 rotational settings of symmetry lines
1, 3, 5, 7, 9, 11, 13, 15 magnetic flux changes
2, 4, 6, 8, 10, 12, 14, 16 alternating current half waves

The invention claimed is:

1. Electrical ignition procedure for internal combustion engines, using an arrangement of multiple coils (U1, U5) and of a magnetic generator (P, M, S, N) that is coupled with the machine and turns synchronous to the machine, whose magnetic field partially flows through the coils (U1, U5) and thereby generates a sequence of magnetic flux changes (Ba, 1, 3, 5, 7; Bb, 9, 11, 13, 15) for each revolution, whereby a sequence of corresponding alternating current half waves (2, 4, 6, 8; 10, 12, 14, 16) is induced in the coils (U1, U5), that are used for:

charging an energy storage element (U4) that is discharged by activated an ignition switch (U9) via the primary coil winding (Lp) of an ignition transmitter (U5) for triggering an ignition spark (FU) for the combustion engine scanning, acquiring, processing and/or assessing via a microelectronic and/or programmable control device (U8), that is used for activating the ignition switch (U9) at an ignition time (Zzp) in dependence on the acquired and assessed alternating current half waves (P1...4, A1, A2) and/or on the state of the internal combustion engine, and for formation of the power supply (VDD) for the control device (U8), characterized by an operating mode that is realized or able to be realized with the control device for switching combustion off for the internal combustion engine, whereby by means of the correspondingly arranged control device (U8), the ignition switch (U9) is guided over less than, or for a fraction of, the time span that is needed for a complete revolution of the magnetic generator.

2. Procedure according to claim 1, characterized in that for preventing excess charging of the energy storage element (U4) above a maximum permissible voltage value, the ignition switch (U9) is guided exclusively at such rotational angle ranges in which alternating current half waves (4; 8; LSp2, LSp4) are available for charging of the energy storage element.

3. Procedure according to claim 2, whereby, for charging the energy storage element (U4) a charging coil (U1) is used, on which unipolar charging half waves (LS2, LS4) of the induced alternating current are tapped and forwarded to the energy storage element, characterized in that the ignition switch is guided only during the appearance of these unipolar charging half waves (LS2, LS4).

4. Procedure according to claim 3, characterized in that for guiding by means of the control device, a single electrical pulse is generated per charging half wave (4; 8; LSp2, LSp4).

5. Procedure according to claim 1, characterized in that the ignition switch (U9) is guided by means of the appropriately installed control device (U8) per revolution through an electrical pulse or another sequence of electrical, temporally spaced impulses.

6. Procedure according to claim 5, characterized in that the pulse or the multiplicity of pulses are generated temporally within the appearance of the unipolar charging half waves (LS2, LS4) or such rotation angle ranges, in which alternating current half waves (4; 8; LSp2, LSp4) are available for charging the energy storage element.

7. Procedure according to claim 5, characterized in that by means of the appropriate parameterized and/or furnished control device (U8) the interval of the impulses or a keying ratio of the pulse is adjusted so that the charging of the energy storage element (U4) is kept below a voltage value suitable to prevent ignition sparks and/or until up to a maximum permissible voltage value.

8. Procedure according to claim 7, characterized by a keying ratio from 3% to 30%, preset by means of the control device.

9. Procedure according to claim 5, characterized in that by means of the appropriate parameterized and/or furnished control device (U8), the interval of the impulses or a keying ratio of the pulse is measured in dependence on an air gap dimension between the coil arrangement and the magnetic generator and/or on a rotation angle position and/or speed of the magnetic generator (P, M, S, N) recognized in the control device with the aid of the alternating current half waves (2, 4, 6, 8; 10, 12, 14, 16).

10. Procedure according to claim 1, characterized in that for switching combustion off, the ignition switch (U9) is guided by means of the control device (U8) in such a rotation angle range, where an ignition spark triggered at the spark gap (FU) does not lead to a combustion that accelerates the internal combustion engine.

11. Procedure according to claim 10, characterized in that the ignition switch (U9) is guided in the area of the lower dead center or in an angular range closer at the lower than at the upper dead center or correspondingly at about 80 degrees before a lower dead center up to about 80 degrees after a lower dead center.

12. Procedure according to claim 1, characterized in that for switching the combustion off, the control device (U8) is set up to refrain from guiding the ignition switch (U9) in the rotational angle range from about 90 degrees before an upper dead center of the internal combustion engine until about 5 degrees after the upper dead center.

13. Procedure according to claim 1, characterized in that the control device (U8) is set up to guide the ignition switch once or multiple times outside the rotation angle range from about 90 degrees before an upper dead center of the internal combustion engine to about 5 degrees after the upper dead center of the ignition switch (U9).

14. Procedure according to claim 1, characterized in that the half waves (2, 4, 6, 8) of the charging coil are detected to determine the rotational setting and speed and the rotational direction.

15. An ignition module for carrying out an ignition procedure the ignition module including a yoke core (K) that can be magnetized and is surrounded by multiple induction coils (U1, U5), that has at least a first leg (Ka) surrounded by a charging coil (U1) and a second leg (Kb) that is surrounded at least by the primary and secondary coils (Lp, Ls) of an ignition transmitter (U5), with an energy storage element (U4) that is connected with the charging coil (U1), that by means of an ignition switch (U9) can be discharged via the primary coil winding (Lp) of the ignition transmitter (U5) for triggering an ignition spark (FU), with a microelectronic and/or programmable control device (U8) that is connected with the coils (U1, U5) for scanning, detection, processing and/or assessment of its alternating current half waves (2, 4, 6, 8; 10, 12, 14, 16) and is embodied for activating the ignition switch (U9) depending on the alternating current half waves (2, 4, 6, 8; 10, 12, 14, 16), whereby one input of the control device is coupled to its power supply (VDD) via a rectifier (D4) with one of the coils (U1), characterized in that the power supply input (VDD) of the control device (U8) is coupled via the rectifier (D4) with the charging coil, and between the charging coil and the control device, an ohmic resistance is placed with more than 3 kOhm.

* * * * *